United States Patent [19]

O'Neil, deceased

[11] 4,297,057

[45] Oct. 27, 1981

[54] PIVOTAL ROOF BOLTER AND EXTENDABLE ROTATABLE PROTECTIVE CANOPY FOR MINING MACHINE

[75] Inventor: John C. O'Neil, deceased, late of Columbus, Ohio, by Jean M. O'Neil, executor

[73] Assignee: Dresser Industries, Inc., Dallas, Tex.

[21] Appl. No.: 972,759

[22] Filed: Dec. 26, 1978

[51] Int. Cl.[3] ..... E21D 19/04

[52] U.S. Cl. ..... 405/303; 299/12; 299/33; 175/219

[58] Field of Search ..... 299/11, 12, 33; 175/219; 405/295, 303; 52/73, 115; 182/141, 148; 248/354 H

[56] References Cited

U.S. PATENT DOCUMENTS

| | | | |
|---|---|---|---|
| 1,337,487 | 4/1920 | Schlatter | 52/115 X |
| 2,711,634 | 5/1949 | Joy | 299/11 X |
| 3,546,831 | 12/1970 | Romo et al. | 52/115 |
| 3,865,197 | 2/1975 | McCormick | 175/219 X |
| 3,893,520 | 7/1975 | McCormick | 175/219 X |
| 4,108,253 | 8/1978 | Woodford | 175/219 X |

*Primary Examiner*—Ernest R. Purser

*Attorney, Agent, or Firm*—John M. Lorenzen; Paul E. Krieger

[57] ABSTRACT

The invention is an improvement for a combination mining machine and roof bolting apparatus in which the roof bolting mechanism is pivotable and can be used to install roof bolts in more than one location without moving the mining machine. The improvement is a pivotable canopy which pivots independently of, but in association with, the bolting apparatus. It comprises a canopy shield pivotably and cantileveredly mounted on the upper section of a telescopically-extensible mast. The telescopic mast absorbs all the moment loads, while the hydraulic extension cylinder disposed interiorily of the mast incurs only axial compressive loading.

5 Claims, 4 Drawing Figures

PIVOTAL ROOF BOLTER AND EXTENDABLE ROTATABLE PROTECTIVE CANOPY FOR MINING MACHINE

BACKGROUND OF THE INVENTION

This invention relates to mining machines and, in particular, continuous coal mining machines which are equipped with a device which can be used for installing roof support bolts as the mining machine advances along a mine entry.

Much underground coal mining is done by continuous mining machines which remove coal along the full height of the coal seam and include a gathering and conveying system so that the machine can advance while it mines. In order for such machines to advance greater distances into a seam, depending on roof conditions, continuous mining machines have been equipped with devices for installing roof support bolts in the mine roof. This has been done to save time by eliminating the need to back the mining machine out of an entry and have a separate roof bolting machine install the roof bolts.

It has been found that by positioning such a roof bolting unit on each side of a continuous mining machine, two bolts may be installed along the lateral center line of a mine entry. It has also been found that this does not always provide sufficient support for the mine roof and that additional bolts normally must be installed in order to provide safe roof conditions. Thus, even though provision of roof bolting units on a mining machine can provide more efficient installation of roof bolts, additional roof bolts must be installed along the lateral center line of a mine entry which requires use of a separate roof bolting machine and limits the distance a mining machine can advance before the additional bolting operation must be performed.

Whenever these roof bolt installation units are mounted on a continuous mining machine, the bolter operator might be exposed to rocks or debris which might fall from the mine roof while installing the roof bolt. A protective canopy can be provided which operates to shield the operator from falling rock. Such a canopy is normally formed of heavy material and takes up a relatively large amount of space in order to provide adequate protection.

SUMMARY OF THE INVENTION

The problems discussed above have been solved by the invention which is described below. The capability of installing a greater number of roof bolts without increasing the number of expensive roof bolting units has been provided as well as a protective canopy which has a relatively low weight and takes up minimal space.

Additional roof bolts can be installed by the same number of bolter units by mounting each unit on an arm which itself is pivotally mounted on the continuous mining machine. The bolter and arm are positioned so that the bolter unit can pivot through a 180° swing. For example, if the pivot axis of the arm on each side of the machine is located four feet from the machine's longitudinal center line and the arm length is two feet, four bolts can be installed four feet apart along the lateral center line of the mine entry by positioning each bolter on one side of its 180° swing and installing the roof bolts and then rotating it to the other side of the axis. In this way the bolting capacity of the continuous mining machine can at least be doubled without increasing the number of bolters.

A canopy constructed in accordance with the invention is provided for each bolter and designed to provide adequate protection for the operator at all positions of the bolters and still be relatively light in weight and small in size. The canopy is extendable from a lowered position to a raised position so that the canopy can be raised to abut the mine roof to support the roof as well as provide an extra measure of protection. The canopy is fan-shaped and rotatable through 360+ so that the size and weight are kept to a minimum and the operator is protected at all positions of the bolter. The canopy is cantilevered from a mast. In order to prevent a moment load from being exerted on a hydraulic raising and lowering mechanism, the mast is formed of two telescoping sections which absorb the moment load.

These and other objects of the invention will become apparent from a detailed description of a preferred embodiment set forth below taken in conjunction with the accompanying drawings.

DETAILED DESCRIPTION OF A PREFERRED EMBODIMENT

Figure 1:
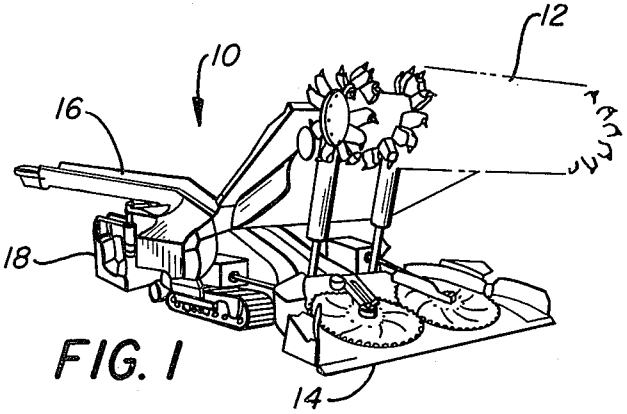
FIG. 1 is a perspective view of a continuous mining machine suitable for use with the pivotal roof bolter and extandable protective canopy.

Referring to FIG. 1, a continuous mining machine is shown which is designated generally by reference numeral 10. The mining machine 10 includes a rotatable and vertically moveable cutting head 12 and a gathering apparatus 14 for transporting coal removed by the cutting head 12 from the mine face (not shown) to a conveyor 16 which extends along the longitudinal axis of the machine 10. The mining machine 10 is controlled by an operator who sits in a compartment 18 located at the rear of the machine 10. Such a machine and its operation are known in the art.

Figure 2:
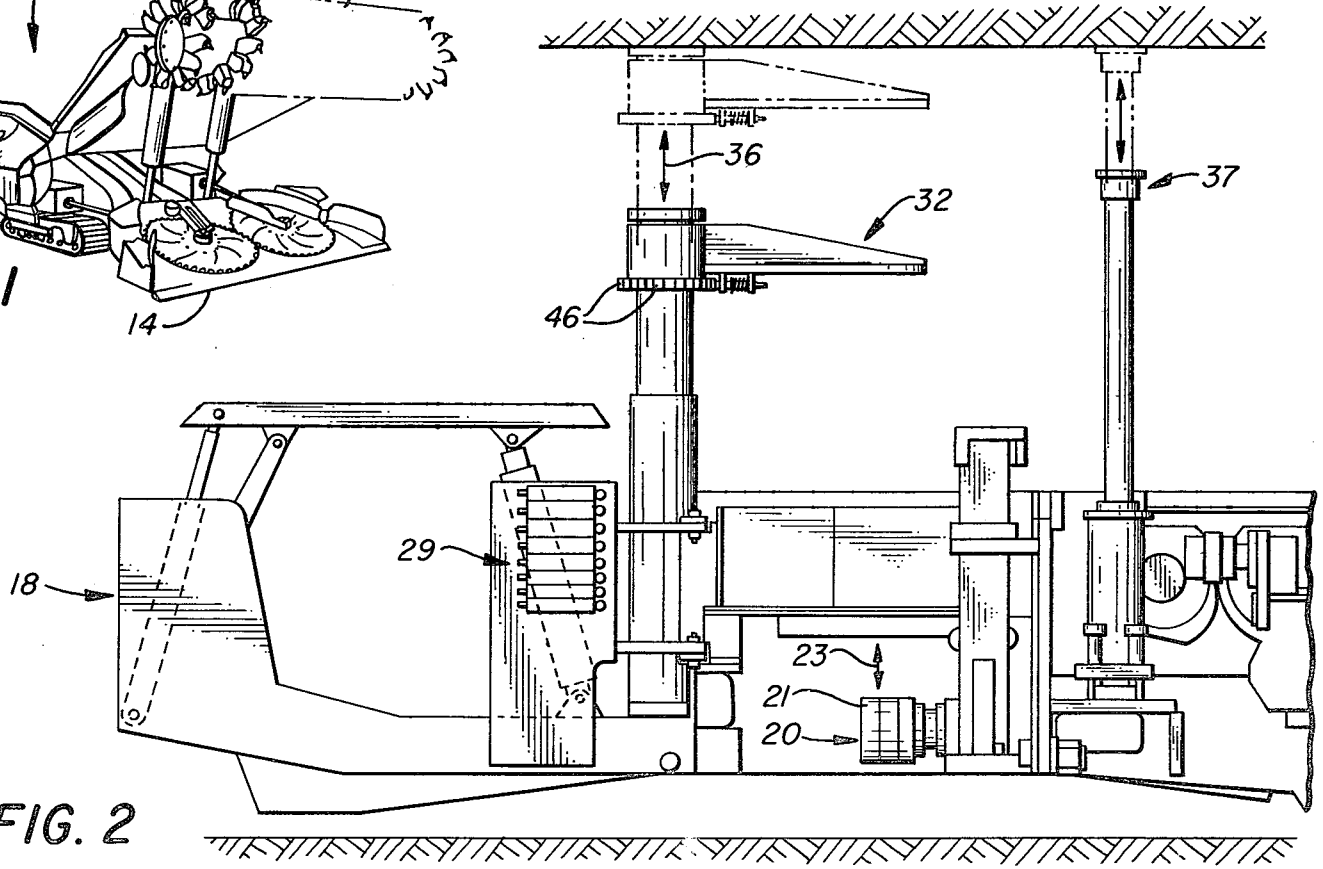
FIG. 2 is a side elevational view of a portion of the machine of FIG. 1, which shows, in particular, a roof bolter and canopy.
Figure 3:
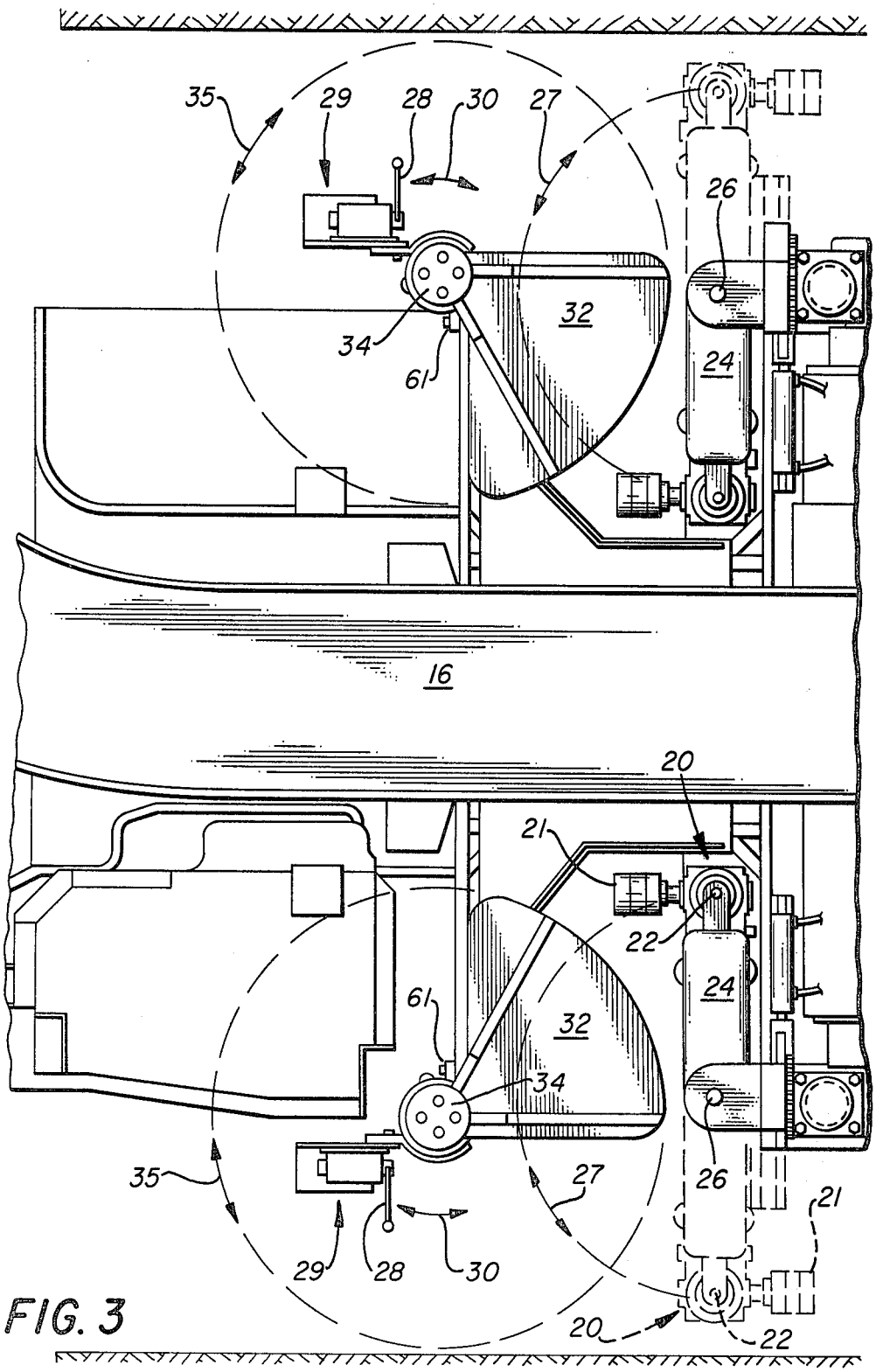
FIG. 3 is a top elevational view of the portion of the machine as shown in FIG. 2, which shows in particular the roof bolter and canopy and their paths of movement.

As shown best in FIGS. 2 and 3, an auger or drill-/roof bolting unit 20 is mounted on each side of the machine 10. The bolting units 20 are known in the art and include a motor 21 for rotating a chuck portion 22 and a suitable mechanism (not shown) for raising and lowering the units as shown by arrow 23 in FIG. 2 so that a hole can be drilled in the mine roof (not shown) and a roof bolt inserted. Since this is a standard operation, no further description will be given.

Each bolter 20 is mounted on an arm 24 which itself is mounted on the mining machine 10 at a pivot point 26 so that each bolter 20 can move through a 180° sweep as shown by the broken lines and arrows 27 in FIG. 3. Movement of each of the bolters 20 is controlled by means of a suitable hydraulic mechanism (not shown). The bolters 20 are controlled by the machine operator manipulating handles 28 of a hydraulic control panel 29 which is pivotally mounted on the machine 10 as shown in FIG. 2 and can be moved as shown by arrows 30 in FIG. 3 for operator convenience.

As shown best in FIG. 3, a protective canopy 32 is located near each of the bolters 20 to protect the operator while he is operating the bolter 20. The canopy 32 is fan-shaped and rotatable throughout 360° sweep about a pivot point 34 as shown by arrows 35, the structure allowing such movement being described in greater detail below. In this way, the canopy 32 can be moved by the operator for protection at any position of the bolter 20 and the weight of the canopy 32 is kept at a minimum. As shown best in FIG. 2, the canopy 32 is also moveable up and down as indicated by broken lines and arrow 36 to provide additional support on the mine roof during bolting operations. Additional roof supports such as those indicated by reference numeral 37 can also be provided.

The canopy 32 is mounted on a shaft generally designated by reference numeral 38 and is formed of 1-inch thick steel plate, weighing 300–400 pounds. In order to provide a canopy which is relatively light in weight and will still protect the operator at all positions of the bolters 20, the canopy 32 is cantilevered from the shaft 38. For the canopy 32 to be vertically moveable, as shown by the arrow 36, without exerting undue force on the hydraulic mechanism used for raising and lowering the canopy 32 (which is described in detail below), the shaft 38 has been designed to absorb all of the moment load of the canopy 32 so that the hydraulic mechanism will only support the vertical load component.

Figure 4:
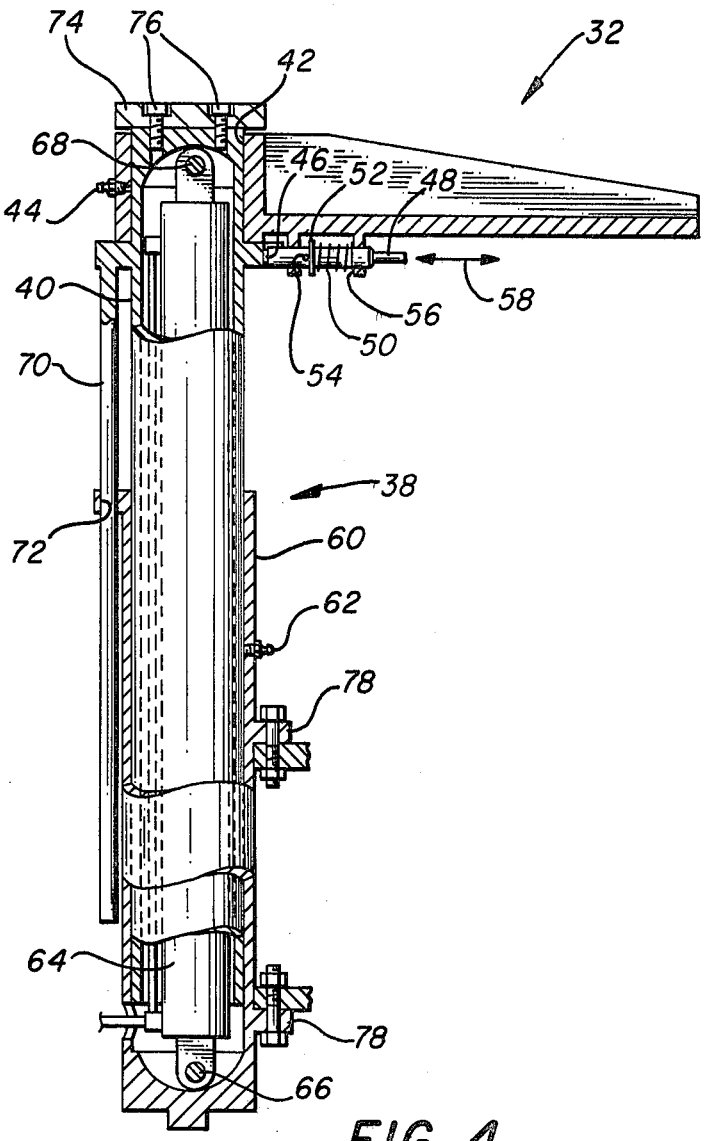
FIG. 4 is a side elevational view, partially in section, showing structural details of the canopy.

As shown in FIG. 4, the shaft 38 includes an inner sleeve 40 on which the canopy 32 is mounted, an opening 42 in the canopy 32 fitting over the top of the inner sleeve 40. A grease connection 44 is provided for lubricating the bearing surfaces between the inner sleeve 40 and opening 42. A plurality of stop openings 46 are spaced apart around the outer surface of the inner sleeve 40 for cooperating with a pin 48 which is moveably mounted on the canopy 32. A spring 50 which bears on one side against a washer 52 held in place by a pin 54 and on the other side against a support 56 for the pin 48 so that the pin can be retracted in the direction of an arrow 58 to allow the operator manually to rotate the canopy 32 as indicated by the arrows 35. When the desired position is reached, the operator releases the pin 48 and the spring 50 will urge it back into the appropriate stop opening 46.

The shaft 38 also includes an outer sleeve 60 which is connected to the mining machine 10 by appropriate means such as, for example, appropriate bolts and supports generally indicated on FIG. 3 by reference numeral 61. As shown in FIG. 4, the inner sleeve 40 and outer sleeve 60 are shaped and dimensioned so the inner sleeve is vertically slideable within the outer sleeve 60. A grease connection 62 is provided on the outer surface of the outer sleeve 60 for lubricating the bearing surfaces of the two sleeves. A hydraulic piston and cylinder mechanism 64 is mounted within the inner and outer sleeves 40, 60, the piston being connected to the outer sleeve 60 through a pin 66 and the cylinder being connected to the inner sleeve 40 through a pin 68 to effect the appropriate up and down movement that is shown by the arrow 36.

As shown in FIG. 4, the inner sleeve 40 includes a guide arm 70 which is connected to its outer surface and projects longitudinally relative to the inner sleeve 40 for cooperating with an opening 72 located in a flange projecting from the outer sleeve 60 for preventing any relative rotation between the sleeves 40, 60. A cover 74 is provided on the top of the inner sleeve 40, which is held in place by appropriate bolts 76. A pair of flanges 78 project from the outer surface of the outer sleeve 60, on which the control unit 29 can be mounted, as shown in FIGS. 2 and 3.

Whenever the mining machine 10 reaches a point where roof bolts should be installed forward progress of the machine is stopped and the operator will install the roof bolts along the lateral center line of the mine entry by positioning the bolters 20 at appropriate positions as described above. As the bolter 20 is moved along different positions of the sweep indicated by the arrows 27, the canopy 32 is lowered and rotated as described above, and then raised to provide additional support on the mine roof and protection for the operator. In this way, bolting operations are made more efficient by eliminating the need to move the mining machine out of the entry and bring in a bolting machine.

It should be understood that the invention which has been described in detail above can be modified and improved by those skilled in the art and that all such modifications and improvements are contemplated as falling within the scope of the appended claims.

I claim:

1. A pivotable protective canopy for an underground mining machine which has a work performing apparatus which is pivotable about a vertical axis in order to perform its work at different locations without moving the machine, which canopy is pivotable independent of but associable with the apparatus such that an operator can operate the apparatus while under protection of the canopy, comprising:

a vertically extensible support mast including a first tubular section affixed to the mining machine, and a second tubular section slidably engaged with the first section;

a fluid-pressure operated cylinder disposed interiorally of the tubular sections with one of its ends connected to the first section and its other end connected to the second section; and a canopy shield pivotably mounted on the second tubular section and cantileveredly extending therefrom;

wherein the mast and cylinder are cooperatively operable to raise and lower the canopy shield with respect to the mine roof, and the sliding fit between the tubular mast sections is such that all the moment loads from the canopy shield are transferred through the mast sections to the mining machine, while the fluid cylinder incurs substantially only axial compressive load.

2. The canopy of claim 1, and further including means for selectively locking and unlocking the canopy from rotational movement about the mast.

3. The canopy of claim 1, wherein the canopy is fan-shaped, the canopy being mounted on the second section at the narrow end of the fan-shape.

4. The canopy of claim 1, wherein the mast sections are cylindrical in shape with a telescopic sliding fit.

5. The canopy of claim 4, further including means to prevent relative rotation between the first and second mast sections.

* * * * *